US005753587A

United States Patent [19]

Podszun et al.

[11] Patent Number: 5,753,587

[45] Date of Patent: May 19, 1998

[54] HEAT-SENSITIVE RECORDING MATERIAL

[75] Inventors: Wolfgang Podszun, Köln, Germany; Luc Leenders, Herentals, Belgium

[73] Assignee: Agfa-Gevaert AG, Germany

[21] Appl. No.: 715,196

[22] Filed: Sep. 18, 1996

[30] Foreign Application Priority Data

Sep. 28, 1995 [DE] Germany ..... 195 36 045.1

[51] Int. Cl.[6] ..... B41M 5/34; B41M 5/40

[52] U.S. Cl. ..... 503/210; 427/152; 503/204; 503/226

[58] Field of Search ..... 427/152; 503/204, 503/210, 226

[56] References Cited

U.S. PATENT DOCUMENTS

| | | | |
|---|---|---|---|
| 4,311,750 | 1/1982 | Kubo et al. | 428/212 |
| 4,613,878 | 9/1986 | Inaba et al. | 503/204 |
| 5,196,297 | 3/1993 | Dombrowski, Jr. et al. | 430/338 |

FOREIGN PATENT DOCUMENTS

| | | | |
|---|---|---|---|
| 599 580 | 11/1993 | European Pat. Off. | 503/226 |
| 680 833 | 5/1994 | European Pat. Off. | 503/210 |

*Primary Examiner*—Bruce H. Hess
*Attorney, Agent, or Firm*—Connolly & Hutz

[57] ABSTRACT

A heat-sensitive image recording material contains on a support material 1. at least one binder layer with a heat-sensitive imaging combination of an organic silver salt and an organic reducing agent for the organic silver salt, and
2. at least one binder layer or a sequence of binder layers with a heat-sensitive imaging combination of an acid-sensitive leuco dye and an acidically reacting compound which acts as a developer for the leuco dye, wherein the leuco dye and developer are in thermal interaction with each other either in different layers or separately from each other in the same layer, characterised in that a layer with a water- or alcohol-soluble polymer is arranged between the combination of organic silver salt and organic reducing agent for the organic silver salt, on the one hand, and the combination of leuco dye and acidically reacting compound, on the other.

The image recording material is suitable for recording thermal images with elevated optical density, good grey scale reproduction and good stability.

10 Claims, No Drawings

HEAT-SENSITIVE RECORDING MATERIAL

This invention relates to a heat-sensitive recording material based upon a combination of a heat-sensitive silver salt and all acid-sensitive leuco dye.

Thermal imaging or thermography is a recording process in which images are produced using imagewise modulated thermal energy. Two approaches to thermography are known:

1. Direct thermal production of a visible image pattern by imagewise heating of a recording material which contains substances which change their colour or optical density by means of chemical or physical processes. Such recording materials and the corresponding processes are described below as "directly thermal".
2. Thermal dye transfer printing, wherein a visible image pattern is produced by transferring a coloured substance from an imagewise heated donor element onto a receptor element. In thermal dye transfer printing, a dye donor element is used which has a dye binder layer from which coloured parts or only the dye molecules themselves are transferred by application of heat in a pattern, which is normally produced by electronic data signals, onto a receiving element with which it is in contact.

A review of "directly thermal" imaging processes may be found, for example, in the book *Imaging Systems* by Kurt I. Jacobson and Ralph E. Jacobson, published by The Focal Press, London & New York (1976) in chapter VII under the heading "7.1 Thermography". In thermography, materials are used which are substantially insensitive to light or non-photosensitive, but are instead heat- or thermosensitive. The heat applied in the image areas is sufficient to bring about a visible change in the heat-sensitive recording material.

Most directly thermographic recording materials are of the chemical type. On heating to a certain transformation temperature, an irreversible chemical reaction occurs, so producing a coloured image.

Very many chemical systems have been proposed, some examples of which are given on page 138 of the above-stated book by Kurt I. Jacobson et al.. Production of a metallic silver image is described here using a thermally induced reduction of a silver soap. According to U.S. Pat. No. 3,080,254, a typical heat-sensitive copying paper comprises in the heat-sensitive layer a thermoplastic binder, for example ethyl cellulose, a silver salt insoluble in water, for example silver stearate, together with a suitable organic reducing agent, of which 4-methoxy-1-hydroxy-dihydronaphthalene is a representative example. Locally delimited heating of the recording material in the thermographic reproduction process to a suitable transformation temperature in the range from 90° C. to 150° C. causes a visible change in the heat-sensitive layer. The initially white or light-coloured layer becomes darker and takes on a brownish appearance at the heated point. In order to achieve a more neutral colour hue, a heterocyclic organic toner substance, for example phthalazinone, is added to the heat-sensitive layer.

Heat-sensitive copying papers having a recording layer with a substantially non-photosensitive organic silver salt and a hydroxylamine-type reducing agent in a thermoplastic binder, such as for example ethyl cellulose and post-chlorinated polyvinyl chloride are described in U.S. Pat. No. 4,082,901. When used in thermographic recording processes with thermal print heads, the stated copying papers are not suitable for the reproduction of images with a relatively large number of grey levels, as are necessary for half-tone reproduction.

According to the above-mentioned handbook of imaging materials (pages 499–501), direct thermal recording processes using a leuco dye system are now commercially used.

In an embodiment described by T. Usami and A. Shimura in *Journal of Imaging Technology*, vol. 16, no. 6, Dec. 1990, page 234 to 237, a certain leuco dye system works on a transparent film support with encapsulated leuco dyes in a recording layer which contains a so-called "developer" (for example an acidically reacting bisphenol compound which is dissolved in an organic solvent and dispersed in a water-soluble binder). It may be seen from the curve of optical density against temperature (FIG. 11 on page 236) that optical density is no higher than 1.5 at temperatures of approximately 130° C. and rises no further.

Neither direct thermal single sheet recording material, nor two-sheet thermal dye transfer recording materials (dye donor and receptor materials), in their current commercially available form, are capable of providing images having maximum optical densities of above 2.5 and the gradation necessary for half-tone reproduction.

In certain applications, for example in medical diagnostics, however, the above-stated imaging options must be available and directly thermal recording materials are suitable for such purposes only if they have the above-stated sensitometric properties with regard to optical density and gradation.

According to the hitherto unpublished EP application 94 201 207.1, a heat-sensitive recording material has one or more binder layers on the same side of a support material, the so-called heat-sensitive side, which layers contain a substantially non-photosensitive metal salt in combination with at least one organic reducing agent together with an acid-sensitive leuco dye in combination with an acidically reacting compound, which acts as colour developer. The materials according to EP application 94 201 207 produce images of an elevated optical density and good grey scale reproduction.

The object of the present invention is to provide a heat-sensitive recording material which yields images with elevated optical density, good grey scale reproduction and good stability. A further object of the present invention is to provide a recording material with a simplified layer structure, which may be produced in a simple manner by casting techniques.

The present invention provides a heat-sensitive image recording material which contains on a support material 1. at least one binder layer or a sequence of binder layers with a heat-sensitive imaging combination of an organic silver salt and an organic reducing agent for the organic silver salt, and
2. at least one binder layer or a sequence of binder layers with a heat-sensitive imaging combination of an acid-sensitive leuco dye and an acidically reacting compound which acts as a developer for the leuco dye, wherein the leuco dye and developer are in thermal interaction with each other either in different layers or separately from each other in the same layer, characterised in that a layer with a water- or alcohol-soluble polymer is arranged between the combination of organic silver salt and organic reducing agent for the organic silver salt, on the one hand, and the combination of leuco dye and acidically reacting compound, on the other.

"Thermal interaction" should be taken to mean the possibility that the reactive substances in question which increase image density may come into reactive contact under the action of heat, for example by thermally induced diffusion or by separating elements, such as for example barrier layers or the walls of micro-capsules enclosing one reaction component, becoming permeable under the action of heat.

In a preferred embodiment of the invention, the heat-sensitive recording material according to the invention contains at least four layers on a support material, namely 1. a binder layer with a heat-sensitive imaging combination of an organic silver salt and an organic reducing agent for the organic silver salt (silver salt layer),
2. a layer with a water- or alcohol-soluble polymer,
3. a layer with a leuco dye and a binder for the leuco dye (leuco dye layer) and
4. a layer with a developer for the leuco dye and a water- or alcohol-soluble binder (developer layer), wherein the layer with the water- or alcohol-soluble polymer is arranged between the silver salt layer, on the one hand, and the leuco dye layer and developer layer, on the other.

The support material for the heat-sensitive recording material according to the invention is preferably a thin, flexible support made, for example from paper, polyethylene-coated paper or a transparent plastic film, for example made from a cellulose ester, for example cellulose triacetate, polypropylene, polycarbonate or polyester, for example polyethylene terephthalate. The layer support may be in sheet, strip or web form and, if necessary, may be provided with a base layer in order to improve adhesion of the heat-sensitive recording layer applied thereto. The thickness of the support may, for example, be between 10 and 2000 μm, preferably between 50 and 500 μm.

The recording material according to the invention may be used for the production of transparencies and prints. This means that the layer support may be transparent or opaque, in the latter case the layer support has a white, reflective surface. A paper support is, for example used, which may contain white, reflective pigments, optionally also in an interlayer between a recording layer and the stated support. If a transparent layer support is used, the stated support may be colourless or coloured, for example, with a blue hue. In the area of hard copy production, recording materials on a white, opaque support are used, while in medical diagnostics, black slides for examination with a light box are frequently used.

Organic silver salts which are suitable according to the invention are substantially non-photosensitive. Silver salts of aliphatic carboxylic acids, the so-called fatty acids, in which the aliphatic carbon chain preferably has at least 12 C atoms, are particularly suitable, for example silver laurate, silver palmitate, silver stearate, silver hydroxystearate, silver oleate and silver behenate, together with silver dodecylsulphonate according to U.S. Pat. No. 4,504,575 and silver di-(2-ethylhexyl)-sulphosuccinate according to European patent application 227 141.

Suitable organic reducing agents for the reduction of the silver salt are organic compounds with at least one active hydrogen atom on O, N or C, as in aromatic di- and trihydroxy compounds, for example hydroquinone and substituted hydroquinones, catechol, pyrogallol, gallic acid and gallates, aminophenols, METOL (trade name), p-phenylenediamines, alkoxynaphthols, for example 4-methoxy-1-naphthol according to U.S. Pat. No. 3,094,417, 3-pyrazolidinone-type reducing agents, for example PHENIDONE (trade name), 5-pyrazolinone, 1,3-indandione derivatives, hydroxytetronic acids, hydroxytetronimides, hydroxylamine derivatives (see, for example, U.S. Pat. No. 4,082,901), hydrazine derivatives, Reductone and ascorbic acid; see also U.S. Pat. Nos. 3,074,809, 3,080,254, 3,094, 417 and 3,887,378. Catechol and polyhydroxy-spiro-bis-indan compounds are preferred. The reducing agent is preferably incorporated into the heat-sensitive image layer, but it may, however, be partially or entirely embedded in an adjacent layer, from which it may diffuse into the layer with the organic silver salt.

Suitable binders are primarily natural, modified natural or synthetic resins, for example cellulose derivatives such as ethyl cellulose, cellulose esters, carboxy-methylcellulose, starch ethers, galactomannan, polymers of a,b-ethylenically unsaturated compounds, such as polyvinyl chloride, post-chlorinated polyvinyl chloride, copolymers of vinyl acetate and vinylidene chloride, copolymers of vinyl chloride and vinyl acetate, polyvinyl acetate and partially hydrolysed polyvinyl acetate, polyvinyl alcohol, polyvinyl acetals prepared from polyvinyl alcohol, in which only a proportion of the vinyl alcohol repeat units is reacted with an aldehyde, preferably polyvinyl butyral, copolymers of acrylonitrile and acrylamide, polyacrylic acid esters, polymethacrylic acid esters and polyethylene or mixtures thereof. Polyvinyl butyral with a small quantity of vinyl alcohol units is a particularly suitable binder, as is marketed by Monsanto USA under the trade name BUTVAR B79.

In order to obtain a neutral black image tone with silver in the areas of elevated optical density and a neutral grey in the areas of low density, the reducible silver salts and the reducing agents may advantageously be used in conjunction with a so-called toner substance known from thermography or photothermography. Suitable toner substances are the phthalimides and phthalazinones according to the general formulae described in U.S. Pat. No. 4,082,901. Reference is also made to the toner substances described in U.S. Pat. Nos. 3,074,809, 3,446,648 and 3,844,797. The heterocyclic toner compounds of the benzoxazinedione or naphthoxazinedione type are also particularly suitable toner substances.

The weight ratio of binder to organic silver salt in the silver salt layer is preferably between 0.2 and 6. This layer preferably has a thickness of between 8 μm and 32 μm.

The layer with the water- or alcohol-soluble polymer acts as a barrier layer. Suitable polymers are, for example, polyvinyl alcohol, partially saponified polyvinyl acetate, polyvinylpyrrolidone, polyethylene oxide, polyethylene oxide/polypropylene oxide copolymers, cellulose esters and cellulose ethers. Polyvinyl alcohol is particularly suitable. The thickness of the barrier layer is 0.1 to 10 μm, preferably 0.2 to 5 μm.

Leuco dyes which are particularly suitable for the leuco dye layer are those of the class of fluorans, as are, for example, described in EP-A-0 155 796, in DE-A-35 34 594 and DE-A-43 29 133 and in U.S. Pat. Nos. 3,957,288, 4,011,352 and 5,206,118.

The preferred fluoran-type leuco dyes are of the following general formula (A):

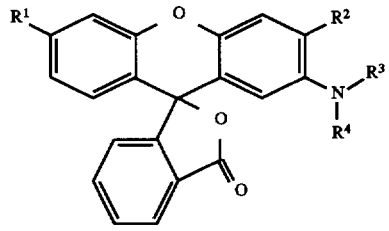

(A)

wherein

R' is a mono- or dialkylamino group in substituted form, for example substituted with a tetrahydrofuryl group, $R^2$ is hydrogen, F, Cl, $C_1$–$C_5$ alkyl, $C_1$–$C_5$ alkoxy, phenyl or benzyl, $R^3$ is hydrogen, a $C_1$–$C_4$ alkyl group, an alkaryl group, a cycloalkyl group or an aryl group, for example a phenyl group, and $R^4$ is a $C_1$–$C_4$ alkyl group, an alkaryl group, a cycloalkyl group or an aryl group, for example a phenyl group.

Other leuco dyes which yield a coloured compound on reaction with an acid are leuco crystal violet, leuco malachite green, crystal violet lactone, benzoyl leuco methylene blue and the acid-sensitive leuco dye compounds of the class of bisindonaphthalides and carbazolylmethanes, which are described in U.S. Pat. No. 5,206,118.

The same binders as for the silver salt layer are suitable as the binder for the leuco dye layer. Vinyl chloride and vinylidene chloride copolymers, such as for example poly (vinyl chloride-co-vinyl acetate) are particularly suitable.

The stated binders may be used in conjunction with waxes or "heat solvents", also known as "thermo-solvents", which improve the rate of the dye formation reaction and the redox reaction which yields the image silver at elevated temperatures.

For the purposes of the present invention, the term "heat solvent" denotes a non-hydrolysable organic material which is in solid form at temperatures of below 50° C., but from approximately 60° C. acts as a plasticiser for the binders, with which it is combined in the heated zone and/or then acts as a solvent for at least one of the chromogenic reaction partners. A compound suitable for this purpose is, for example a polyethylene glycol with an average relative molecular weight of between 1500 and 20000 as described in U.S. Pat. No. 3,347,675. The thickness of the leuco dye layer is 2 to 25 μm, preferably 4 to 15 μm.

Suitable developers for the leuco dye are electron-accepting or acidically reacting compounds. The following may be cited by way of example: 1,3-bis-p-hydroxycumylbenzene or 1,4-bis-cumylbenzene, p-hydroxybenzoic acid butyl ester (PHBB) and bisphenols such as, for example, 4,4'-isopropylidenediphenol (bisphenol A) together with analogous compounds, which are described in *Journal of Imaging Technology,* vol. 16, no. 6, Dec. 1990, page 235 and in DE-A-35 34 594 and DE-A-43 29 133. Other suitable acidically reacting compounds which act as developers for leuco dyes are monoesters of aromatic ortho-carboxylic acids, which are described, for example, in U.S. Pat. No. 4,011,352, in particular the ethyl semi-ester of ortho-phthalic acid.

The developer layer is conveniently produced using those solvents which have no solubilising action on the binder of the leuco dye layer. The binders used in the developer layer are accordingly water- or alcohol-soluble. These may be modified natural or synthetic polymers. Examples which may be cited are cellulose derivatives, polyvinylpyrrolidone and copolymers of vinylpyrrolidone and vinyl acetate. Nitrocellulose is a preferred binder. The thickness of the developer layer is 1 to 15 μm, preferably 3 μm to 10 μm.

The recording material according to the invention may, of course, contain further layers known for this intended application. It may thus be favourable to apply a protective layer (topcoat) as the uppermost layer. This protective layer is conventionally 0.05 to 2.5 μm in thickness.

The protective layer may have non-stick properties, which may be achieved by using polysiloxanes, polysiloxane/polyether block copolymers or fluoropolymers. Polyvinyl alcohol is also suitable as a protective layer.

It has proved favourable when writing the image material with a thermal head to apply a heat-stable protective layer. Polymers suitable for this purpose have a softening point of above 100° C., preferably of above 130° C. Polycarbonate is very suitable, in particular homo- and copolymers of trimethylcyclohexylbisphenol polycarbonate. The last-stated polymers give rise to image materials with particularly elevated gloss and good image sharpness. The thermal head is not contaminated by the image material due to adhesion or abrasion. An additional advantage of these polymers is that they are easy to process, for example by casting from an organic solution.

The recording materials according to the invention may be produced using known techniques. Production by casting or knife coating is favourable. The layer with the water- or alcohol-soluble polymer and the developer layer may simply be cast from water, alcohol or water/alcohol mixtures, for example from methyl alcohol, ethyl alcohol, isopropyl alcohol. Non-aqueous solvents are generally required for the silver salt layer and leuco dye layer. Suitable solvents are, for example, acetone, methyl ethyl ketone, tetrahydrofuran, dioxane, dichloromethane, tetrachloromethane and ethyl acetate.

The heat-sensitive recording materials according to the invention may, for example, be written with a thermal head and provide black-&-white images of elevated optical density ($D_{max}$>2), good grey scale reproduction, elevated sharpness and good stability. Gradation is very suitable, especially in areas of low density, for half-tone reproduction, for example for portrait reproduction on identity documents and in medical diagnostics for the reproduction of images produced, for example, by X-ray, ultrasound or nuclear magnetic resonance (NMR) signals.

The term "gradation" relates to the gradient of an extinction curve which plots optical density (D) as a function (y-coordinate) of linearly increasing quantities of heat on the x-axis. To this end, differing quantities of heat are applied onto the thermographic material in adjacent areas, in a similar manner to the production of a step wedge. The linear increase in heat is achieved, for example, by a linear increase in heating time at various points on the recording material, wherein heat output (J) per unit time (s) is held constant. Alternatively, the heating time may remain constant and the heat output instead increased in a linear manner.

By definition, all the gradients or steepness values of the stated extinction curve together give the gradation of the thermographic image. A gradient corresponds to the steepness at an individual point on the extinction curve. The gamma value (γ) is the maximum gradient of the stated extinction curve and generally corresponds to the gradient between the end of the toe and the beginning of the shoulder of the extinction curve.

Writing with an infra-red laser is also possible, in which case an infra-red absorbent is added to the recording material.

The recording material according to the invention is also particularly advantageous with regard to its environmental impact.

EXAMPLE 1

(According to the Invention)

A silver salt layer of the composition stated below was knife coated from a methyl ethyl ketone solution onto a coated polyethylene terephthalate substrate of a thickness of 125 μm and dried:

| | |
|---|---|
| Silver behenate | 6.63 g/m² |
| Polyvinyl butyral (Butvar ® B79) | 6.63 g/m² |
| 3,3,3',3'-tetramethyl-5,6,5',6'-tetrahydroxy-spiro-bis-indan | 1.26 g/m² |
| 3,4-dihydro-2,4-dioxo-1,3,2H-benzoxazine | 0.50 g/m² |

A barrier layer of polyvinyl alcohol (Moviol® 18/88) was then applied from an aqueous solution at a rate of 2.50 g/m².

A leuco dye layer of the following composition was applied thereon from a methyl ethyl ketone solution and dried:

| | |
|---|---|
| Leuco dye, Yamada Black ® S 205 | 1.60 g/m² |
| Poly(vinyl chloride-co-vinyl acetate) | 9.60 g/m² |

A developer layer of the following composition was applied thereon from a methanol solution and dried:

| | |
|---|---|
| p-Hydroxybenzoic acid benzyl ester | 2.25 g/m² |
| Nitrocellulose | 2.25 g/m² |
| Tegoglide ® 410 | 0.30 g/m² |

EXAMPLE 2

(According to the Invention)

A recording material of the following composition was prepared in accordance with the method stated in example 1.

Substrate: coated polyethylene terephthalate film of a thickness of 100 μm.

| Silver salt layer: | |
|---|---|
| Silver behenate | 6.63 g/m² |
| Polyvinyl butyral (Butvar ® B79) | 6.63 g/m² |
| 3,3,3',3'-tetramethyl-5,6,5',6'-tetrahydroxy-spiro-bis-indan | 1.26 g/m² |
| 3,4-dihydro-2,4-dioxo-1,3,2H-benzoxazine | 0.50 g/m² |

Barrier layer:

| Leuco dye layer: | |
|---|---|
| Leuco dye, Pergascript ® | 2.40 g/m² |
| Poly(vinyl chloride-co-vinyl acetate) | 8.80 g/m² |

Developer layer:

| | |
|---|---|
| p-Hydroxybenzoic acid benzyl ester | 3.75 g/m² |
| Nitrocellulose | 1.25 g/m² |
| Tegoglide ® 410 | 0.30 g/m² |

EXAMPLE 3

(Comparison)

A recording material of the following composition was prepared in accordance with the method stated in example 1.

Substrate: coated polyethylene terephthalate film of a thickness of 100 μm.

| Silver salt layer: | |
|---|---|
| Silver behenate | 6.63 g/m² |
| Polyvinyl butyral (Butvar ® B79) | 6.63 g/m² |
| 3,3,3',3'-tetramethyl-5,6,5',6'-tetrahydroxy-spiro-bis-indan | 1.26 g/m² |
| 3,4-dihydro-2,4-dioxo-1,3,2H-benzoxazine | 0.50 g/m² |
| Topcoat layer: | |
| Nitrocellulose | 1.25 g/m² |
| Tegoglide ® 410 | 0.30 g/m² |

EXAMPLE 4

A test image with 16 grey levels was written using a thermal head printer (Hitachi VY 100 videoprinter) on the recording materials of examples 1 to 3. The optical densities of the individual levels were measured by transmitted light and tabulated.

Optical density

| Level | 2 | 4 | 6 | 8 | 10 | 12 | 14 | 16 |
|---|---|---|---|---|---|---|---|---|
| Example 1 | 0.16 | 0.32 | 0.48 | 0.67 | 1.44 | 3.67 | 4.16 | 4.38 |
| Example 2 | 0.14 | 0.3 | 0.48 | 0.69 | 1.5 | 3.85 | 4.22 | 4.44 |
| Example 3 | 0.04 | 0.04 | 0.04 | 0.07 | 0.68 | 2.89 | 3.08 | 3.14 |

As may clearly be seen from the table, the materials according to the invention are well suited to the reproduction of grey levels, particularly at low densities.

We claim:

1. Heat-sensitive image recording material which comprises a support material and at least four layers on said support material, namely 1. a binder layer with a heat-sensitive imaging combination of an organic silver salt and an organic reducing agent for the organic silver salt (silver salt layer),
2. a layer with a water- or alcohol-soluble polymer (barrier layer),
3. a layer with an acid-sensitive leuco dye and a binder for the leuco dye (leuco dye layer) and
4. a layer with an acidically reacting developer for the leuco dye and a water- or alcohol-soluble binder (developer layer), wherein the leuco dye and developer are in thermal interaction with each other, the barrier layer is arranged between the silver salt layer on the one hand and the leuco dye layer and developer layer on the other.

2. The image recording material according to claim 1, wherein the silver salt layer is 8 to 32 μm thick, the layer of the water- or alcohol-soluble polymer is 0.1 to 10 μm thick, the leuco dye layer is 2 to 25 μm thick and the developer layer is 0.1 to 15 μm thick.

3. The image recording material according to claim 2, wherein the ratio of binder to organic silver salt in the silver salt layer is from 0.2 to 6.

4. The image recording material according to claim 2, wherein the layer of the water- or alcohol-soluble polymer is 0.2 to 5 μm thick.

5. The image recording material according to claim 2, wherein the developer layer is from 3 to 10 μm thick.

6. The image recording material according to claim 5, wherein the layer of water- or alcohol-soluble polymer is 0.2 to 5 μm thick.

7. The image recording material according to claim 6, further comprising a protective layer that is 0.05 to 2.5 μm thick.

8. The imaging recording material according to claim 1, wherein the barrier layer consists essentially of polyvinyl alcohol.

9. The image recording material according to claim 1, wherein the binder of the developer layer is nitrocellulose.

10. The image recording material according to claim 1, further comprising a protective layer that is 0.05 to 2.5 μm thick.

* * * * *

UNITED STATES PATENT AND TRADEMARK OFFICE

CERTIFICATE OF CORRECTION

PATENT NO. : 5753587

DATED : May 19, 1998

INVENTOR(S) : Wolfgang Podszun and Luc Leenders

It is certified that error appears in the above-identified patent and that said Letters Patent is hereby corrected as shown below:

At column 7, line 30, after the phrase " Barrier layer:" please insert - - Polyvinyl alcohol (Moviol ® 18/88) - - .

Signed and Sealed this

First Day of September, 1998

*Attest:*

*Attesting Officer*

BRUCE LEHMAN

*Commissioner of Patents and Trademarks*